US006283354B1

(12) United States Patent
Hirota et al.

(10) Patent No.: US 6,283,354 B1
(45) **Date of Patent: *Sep. 4, 2001**

(54) SHEET PROCESSING APPARATUS

(75) Inventors: Kazuhiro Hirota; Hisao Hosoya; Satoru Endo, all of Hachioji; Kazuyoshi Omi, Kawagoe; Yuji Kanazawa, Musashino; Takanori Yoshida, Toda; Mamoru Tomotsune, Asaka; Yukihiko Nishimoto, Akiruno, all of (JP)

(73) Assignee: Konica Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/211,130

(22) Filed: Dec. 14, 1998

(30) Foreign Application Priority Data

Dec. 18, 1997 (JP) ..... 9-349424
Dec. 18, 1997 (JP) ..... 9-349425

(51) Int. Cl.[7] ..... B42B 1/12; B65H 31/00

(52) U.S. Cl. ..... 227/39; 227/99; 227/140; 227/154; 270/58.08; 270/58.12

(58) Field of Search ..... 227/39, 140, 154, 227/155, 99, 40; 270/58.12, 58.17, 58.08; 399/410

(56) References Cited

U.S. PATENT DOCUMENTS

| | | | | |
|---|---|---|---|---|
| 4,134,672 | * | 1/1979 | Burlew et al. | 227/39 |
| 4,382,592 | * | 5/1983 | Harding et al. | 227/99 |
| 4,444,491 | * | 4/1984 | Rinehart et al. | 227/155 |
| 4,988,029 | * | 1/1991 | Fiske | 227/39 |
| 5,037,077 | * | 8/1991 | Kubota et al. | 270/58.08 |
| 5,098,074 | * | 3/1992 | Mandel et al. | 270/58.08 |
| 5,385,340 | * | 1/1995 | Hiroi et al. | 270/58.08 |
| 5,398,918 | * | 3/1995 | Rizzolo et al. | 270/58.08 |
| 5,409,202 | * | 4/1995 | Naramore et al. | 270/58.12 |
| 5,443,249 | * | 8/1995 | Rizzolo et al. | 270/58.08 |
| 5,551,681 | | 9/1996 | Ferrara . | |
| 5,592,280 | * | 1/1997 | Ishizuka et al. | 227/155 |
| 5,639,078 | * | 6/1997 | Mandel et al. | 270/58.12 |
| 5,642,876 | | 7/1997 | Ferrara et al. . | |

FOREIGN PATENT DOCUMENTS

| | | |
|---|---|---|
| 0 346 851 A1 | 12/1989 | (EP) . |
| 60-142359 | 7/1985 | (JP) . |
| 60-158463 | 8/1985 | (JP) . |
| 62-239169 | 10/1987 | (JP) . |
| 62-288002 | 12/1987 | (JP) . |
| 63-267667 | 11/1988 | (JP) . |
| 1-181672 | 7/1989 | (JP) . |
| 2-276691 | 11/1990 | (JP) . |
| 5-41991 | 6/1993 | (JP) . |
| 7-76190 | 3/1995 | (JP) . |
| 8-42728 | 2/1996 | (JP) . |
| 8-85662 | 4/1996 | (JP) . |
| 8-85663 | 4/1996 | (JP) . |

* cited by examiner

*Primary Examiner*—Scott A. Smith
(74) *Attorney, Agent, or Firm*—Frishauf, Holtz, Goodman, Langer & Chick, P.C.

(57) ABSTRACT

A sheet processing apparatus has a function of stapling sheets together, wherein the sheets are fed from an image forming apparatus one by one after images are formed on the sheets. The sheet processing apparatus includes a stapler to staple the sheets together, a sheet guide which guides the sheets along a sheet transporting path from the image forming apparatus to a position at which the sheets are stapled by the stapler, and a reference surface against which edges of the sheets are butted to stop movement of the sheets. The sheets are guided along the sheet transporting path by the sheet guide and the edges of the sheets are butted against the reference surface at a same position relative to a sheet conveying direction, irrespective of whether the sheet processing apparatus is in a stapling mode in which the stapler staples the sheets or a non-stapling mode in which the stapler does not staple the sheets, and irrespective of sizes of the sheets.

11 Claims, 13 Drawing Sheets

PROCESSING FOR THE SETS OF ODD-NUMBERED ORDER; (THE 1ST, 3RD, 5TH,---SETS);

PROCESSING FOR THE SETS OF EVEN-NUMBERED ORDER; (THE 2ND, 4TH, 6TH,---SETS).

FIG. 10 ( a )
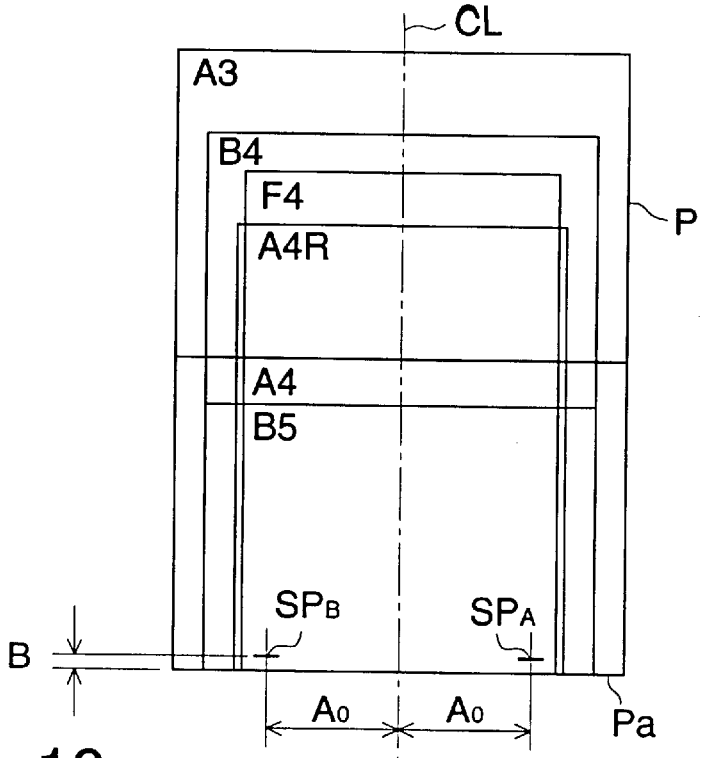
FIG. 10 ( b )
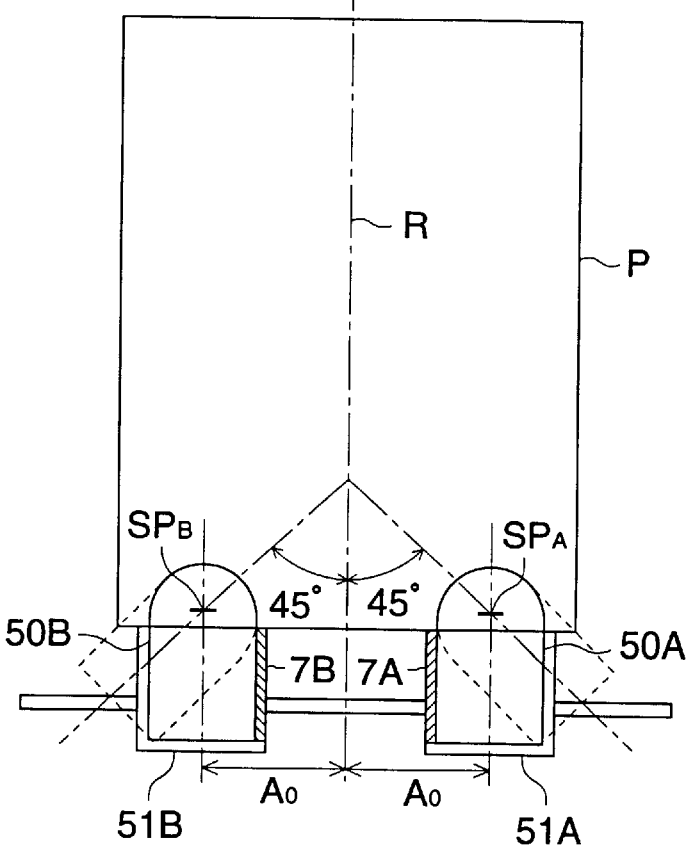

SHEET PROCESSING APPARATUS

BACKGROUND OF THE INVENTION

This invention relates to a sheet processing apparatus which receives sheets whereon an image is formed by an image forming apparatus such as an electrophotographic copying machine, a printer, or a printing machine and discharges them onto a receiving tray by a discharging means after finishing processes such as inverting upside down, stacking, and binding together.

For an apparatus which collates a plurality of sheets with an image formed by an image forming apparatus ejected from the apparatus for each set of copies and binds them with a stapler, a sheet processing apparatus, called as a finisher, is used.

This finisher is functionally connected to an image forming apparatus such as a copying machine, or a printer, and is designed to be driven corresponding to the sequential operation of the copying or printing process.

Accordingly, for an image forming apparatus capable of forming images at a high speed and for a high volume, it is required that the finisher be capable of high-speed and high-volume processing which can fulfill the function in accordance with the processing speed.

Concerning such kind of a finisher capable of high-speed processing, several proposals have already been disclosed in the Japanese laid open patents S60-142359, S60-158463, S62-239169, S62-288002, S63-267667, and H2-276691, and Japanese publicized patent H5-41991.

The sheets with an image formed on them, conveyed out of the image forming apparatus mainframe, are successively stacked in an intermediate stacking plate in the collated order, and are subjected to sheet processings such as stapling, etc., after a set of copy sheets are stacked. The bound set of copy sheets are carried on the discharging belt provided at the bottom of said intermediate stacking plate, transported, held between a pair of upper-and-lower ejecting rollers, and are discharged onto the receiving tray.

The sheet processing apparatus described in the Japanese laid open patent H8-42728 is provided with a stapler and a receiving tray corresponding to it. Further, the sheet processing apparatus described in the Japanese laid open patent H7-76190 is provided with two staplers and two receiving trays corresponding to them.

The sheet inverting system described in the Japanese laid open patent H8-85663 has two different positions for positioning the leading edge of sheets, a first one at which stapling is carried out, and at a second one at which stapling is not carried out; these two different positions are determined by a movable finger for position adjusting.

The tray apparatus described in the Japanese laid open patent H1-181672 is provided with a stopping portion made up of a soft member for stopping the trailing edge of the paper sheets stacked on the receiving tray and an urging member for urging one end portion of said soft member upward.

In the conventional sheet processing apparatus, the sheets with an image formed on them, conveyed out of the image forming apparatus, are subjected or not subjected to the processings by the sheet processing means (including stapler, shifting means, bookbinding means, punching means, etc.), transported, and ejected onto the receiving tray by the discharging means, where they are sliding down along the tilted surface of the tray until their trailing edges collide with the stopper to be stopped there. On the other hand, the sheets which are not to be subjected such processings are directly ejected onto the fixedly attached tray where they are sliding down the tilted surface of the tray until their trailing edges collide with the stopper to be stopped there.

In regard to the conventional sheet processing apparatus and the conventional sheet discharging apparatus, the problems to be solved will be described in the following.

(1) The sheets with an image formed on them are transported by the sheet processing apparatus; however, the sheet transport path in the stapling process mode having the intermediate stacking plate is different from the sheet transport path in the non-stapling process mode; hence, the sheet transport path is long and large and has a complex structure, which results in poor sheet transport. Further, because a bifurcating means for switching the path, a number of transport rollers, driving means for these, control means, and so forth are required, there are problems in that the apparatus is made complex and large-sized, and that the manufacturing cost is increased.

(2) In the sheet inverting system described in the Japanese laid open patent H8-85663, there are provided two different positions for positioning the leading edge of sheets, a first one at which stapling process is carried out, and a second one at which stapling process is not carried out; these two different positions are determined by a movable finger for position adjusting. Because this sheet inverting system uses the movable finger for positioning oscillation, there is a problem that it requires a driving source and a driving means, which makes its structure complex and increases the risk of malfunction. Further, because the movable finger oscillates at a fixed position, it is difficult to carry out the positioning of the leading edge of the sheet precisely for all sizes of the sheets from the minimum size (A6R size for example) to the maximum size (A3 size for example).

SUMMARY OF THE INVENTION

It is an objective of this invention to provide a sheet processing apparatus which achieves (1) accurate positioning regarding the leading edge of the sheets with an image formed on them to stop the sheets both in the stapling process mode and in the non-stapling process mode, and (2) accurate and stable sheet stopping with the member having a basic surface for sheet stopping made to have a simple structure.

BRIEF DESCRIPTION OF DRAWINGS

Other objectives and advantages of the present invention will become apparent upon reading the following detailed description and upon reference to the drawings in which:

FIGS. 10(*a*) and 10(*b*) are a plan showing how the stapling is done at tow points of the sheets of various sizes and a plan showing the disposition of the stapler;

DETAILED DESCRIPTION OF THE PREFERRED EMBODIMENT

In the following, a sheet processing apparatus embodied in the present invention will be described in detail, referring the attached drawings.

Figure 1:
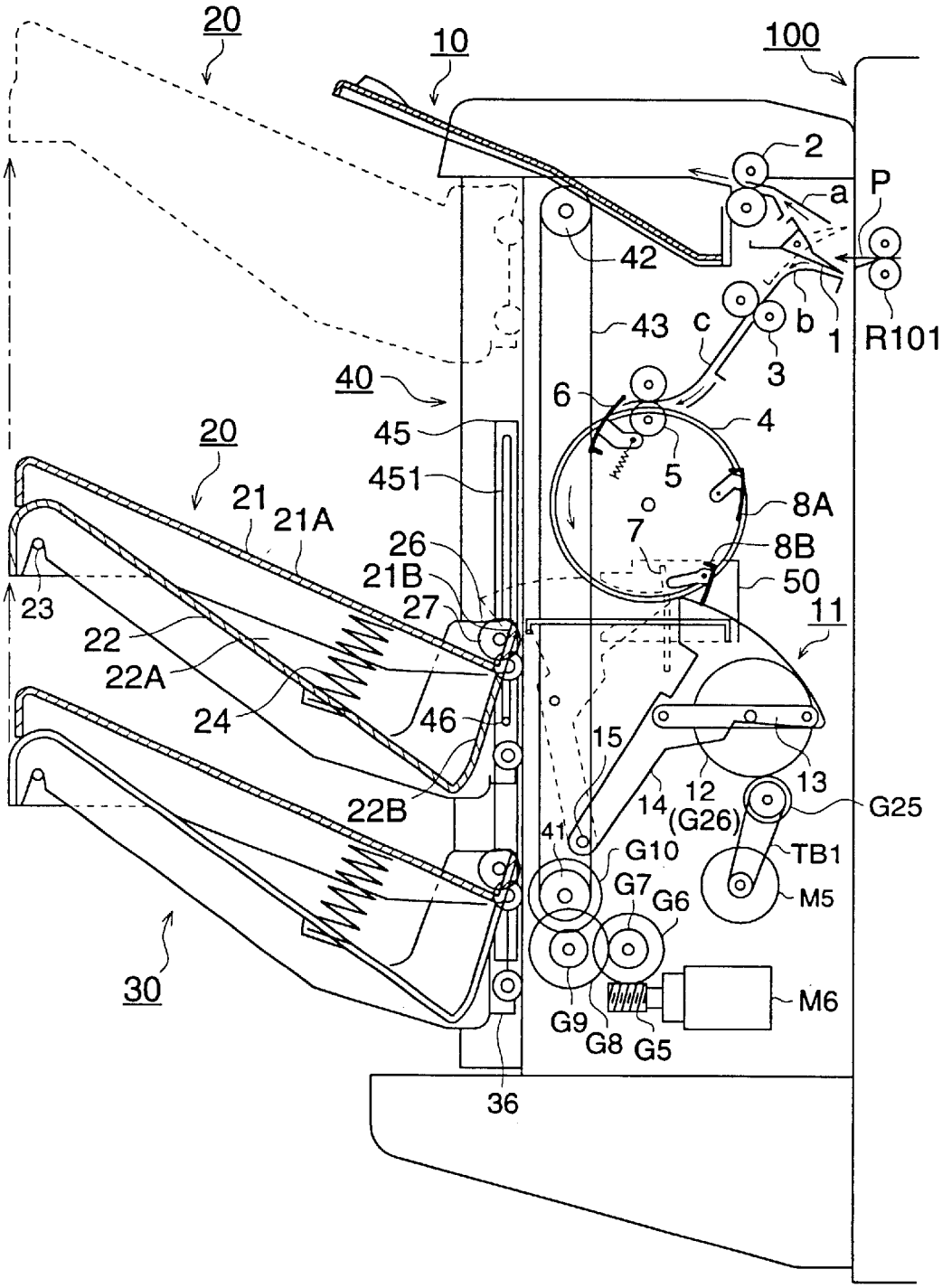
FIG. 1 is a cross-sectional view showing the structure of a sheet processing apparatus of this invention.
Figure 2:
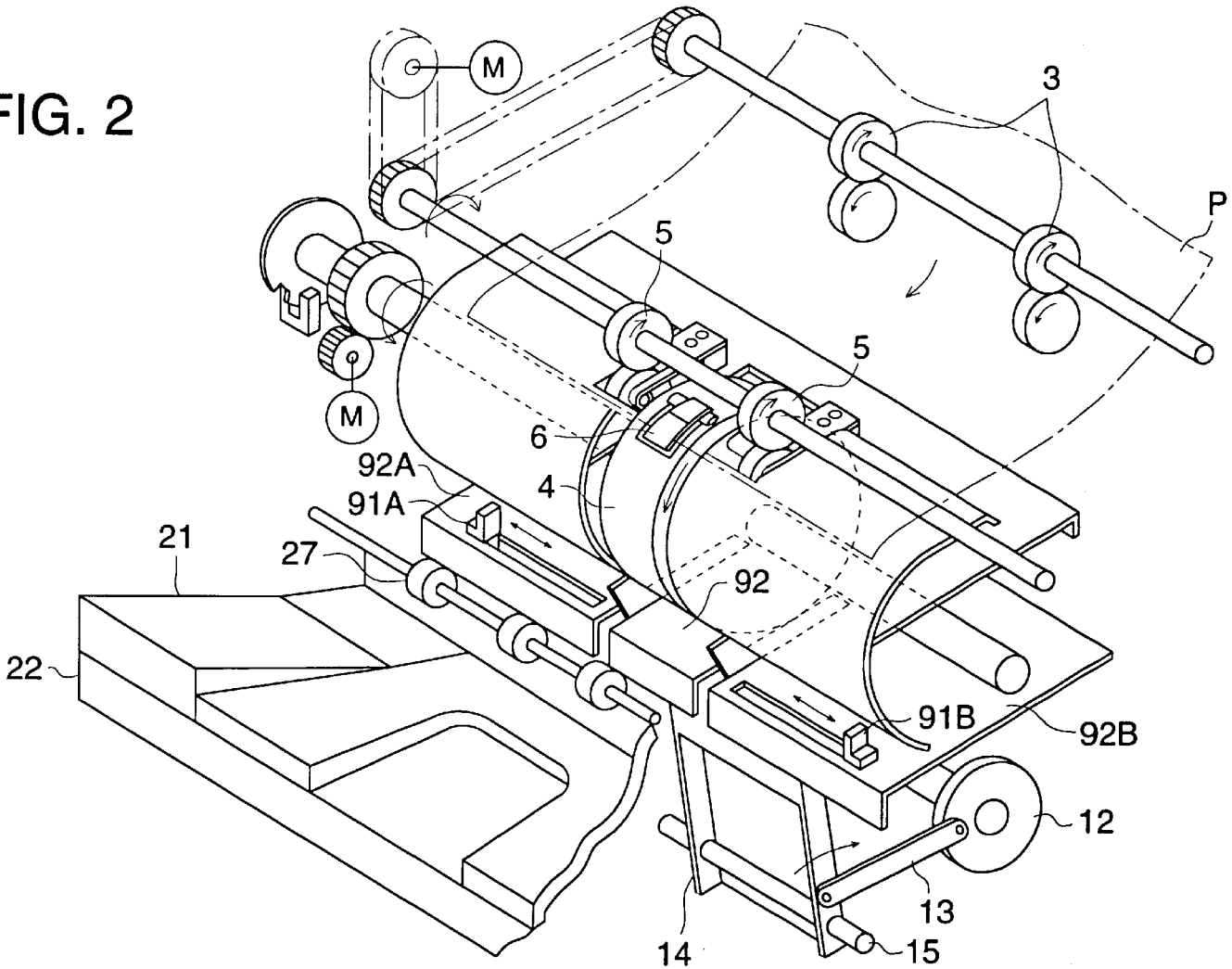
FIG. 2 is a perspective view of the sheet inverting-transporting portion and the discharging portion of the sheet processing apparatus.

FIG. 1 is a cross-sectional view showing the structure of the above-mentioned sheet processing apparatus (finisher). FIG. 2 is a perspective view of the sheet inverting-transporting portion and the paper ejecting portion of said sheet processing apparatus.

The aforesaid sheet processing apparatus is installed with its position and level adjusted in a manner such that the receiving portion for the sheet P coincides with the paper ejecting exit of the image forming apparatus (such as a copying machine or a printer) mainframe, and is connected to the control system so as to be driven corresponding to the operation of the image forming apparatus mainframe.

Regarding sheet P that is introduced into the aforesaid receiving portion, its transport path can be switched to upper transport path "a" and lower transport path "b" by the oscillating switch of switching gate 1 (diverging plate).

Sheet P ejected by the pair of ejecting rollers R101 of image forming apparatus mainframe 100 passes the upper transport path by the switching of switching gate 1 of the aforesaid receiving portion, and is ejected to receiving tray 10 fixedly arranged at the uppermost stage of the sheet processing apparatus, held between the pair of ejecting rollers 2.

On the other hand, sheet P, which has passed lower transport path "b" by the switching of switching gate 1 of the aforesaid receiving portion, is transported by the pair of intermediate transport rollers 3 composed of a driving roller and a pinch roller, passing transport path "c" made up of a fixed guiding plate, and is further transported onto the circumferential surface of sheet transporting drum 4 held between the pair of transporting rollers 5 located above drum 4. Sheet transporting drum 4 is driven to rotate in the direction of the arrow by a driving source (not shown). Near the circumferential surface of sheet transporting drum 4, sheet holding member 6 (hereinafter referred to as gripper 6) is supported to be able to oscillate. Gripper 6 is urged by a spring and is made to oscillate by a cam mechanism (not shown).

The leading edge of sheet P, which is conveyed out from the nip position of transporting roller pair 5 onto the circumferential surface of sheet transporting drum 4, enters into the V-shaped clearance portion between the front end portion of gripper 6 which is made to be in the open state by the aforesaid cam mechanism and the circumferential surface of sheet transporting drum 4, and is further transported with sheet transporting drum 4, pressed and held between the front end portion of the spring-urged gripper 6 and the circumferential surface of the rotating sheet transporting drum 4. In addition, at the time of this sheet transport, the circumferential speeds of transporting roller pair 5 and sheet transporting drum 4 are equal.

Figure 3:
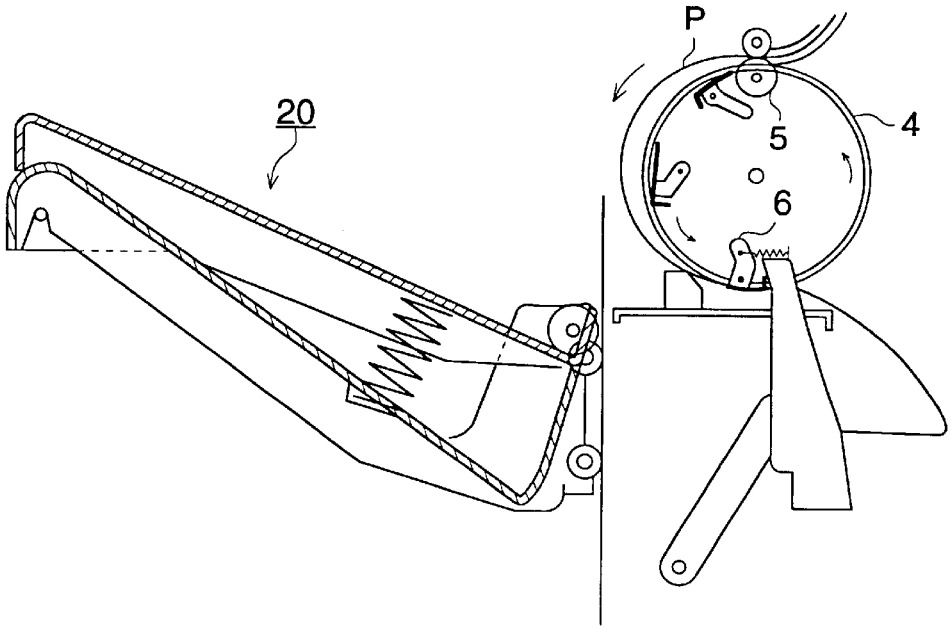
FIGS. 3(*a*) and 3(*b*) are partial cross-sectional views showing the sheet transporting process of the sheet processing apparatus.
Figure 3:
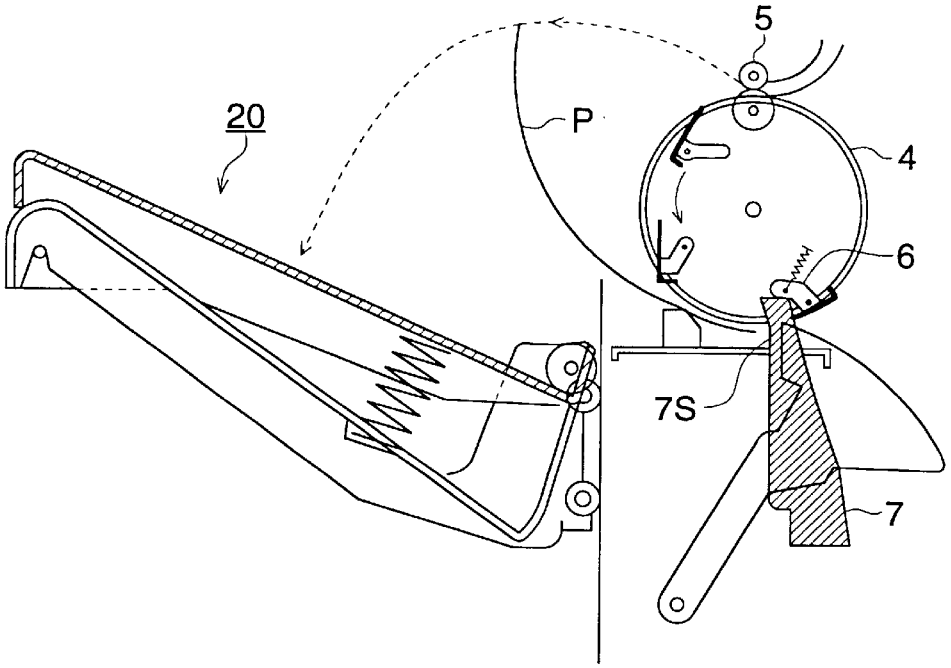
Figure 4:
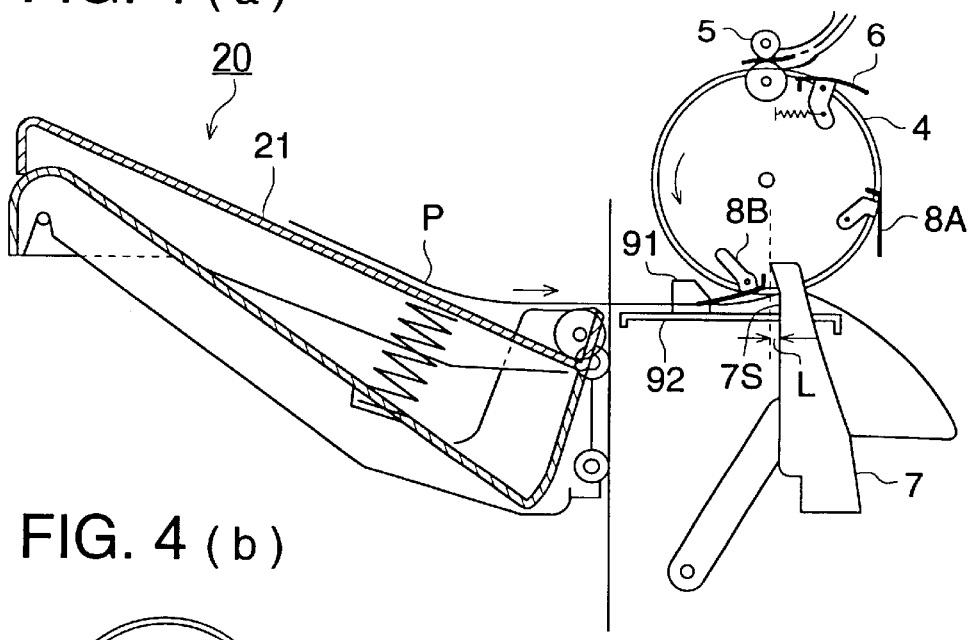
FIGS. 4(*a*) through 4(*c*) are partial cross-sectional views showing the sheet transporting process of the sheet processing apparatus.
Figure 4:
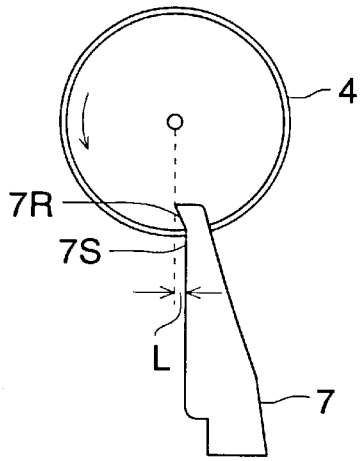
Figure 4:
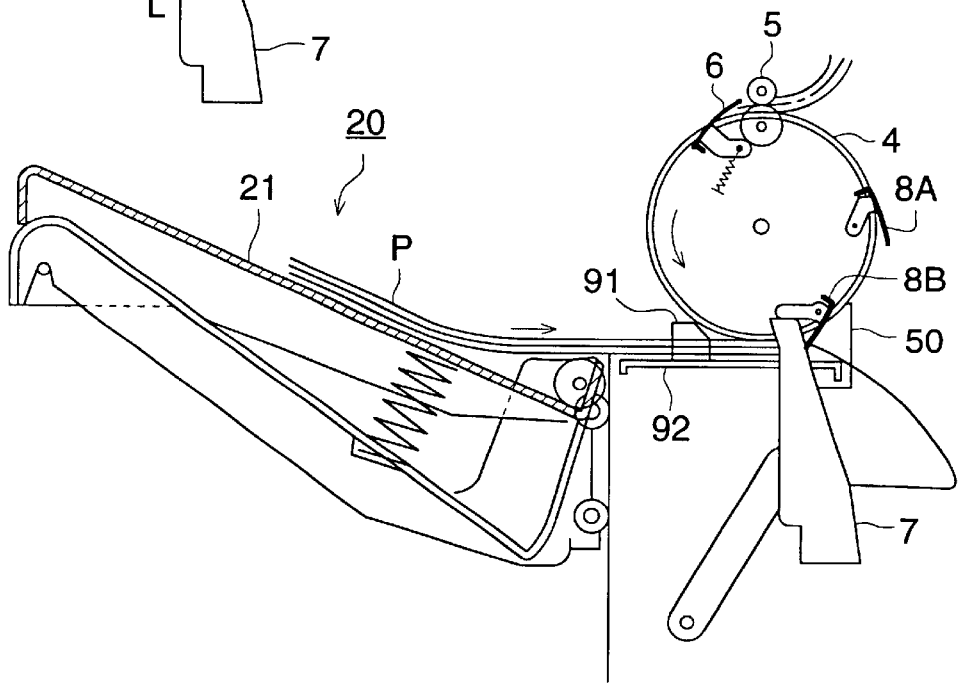
Figure 5:
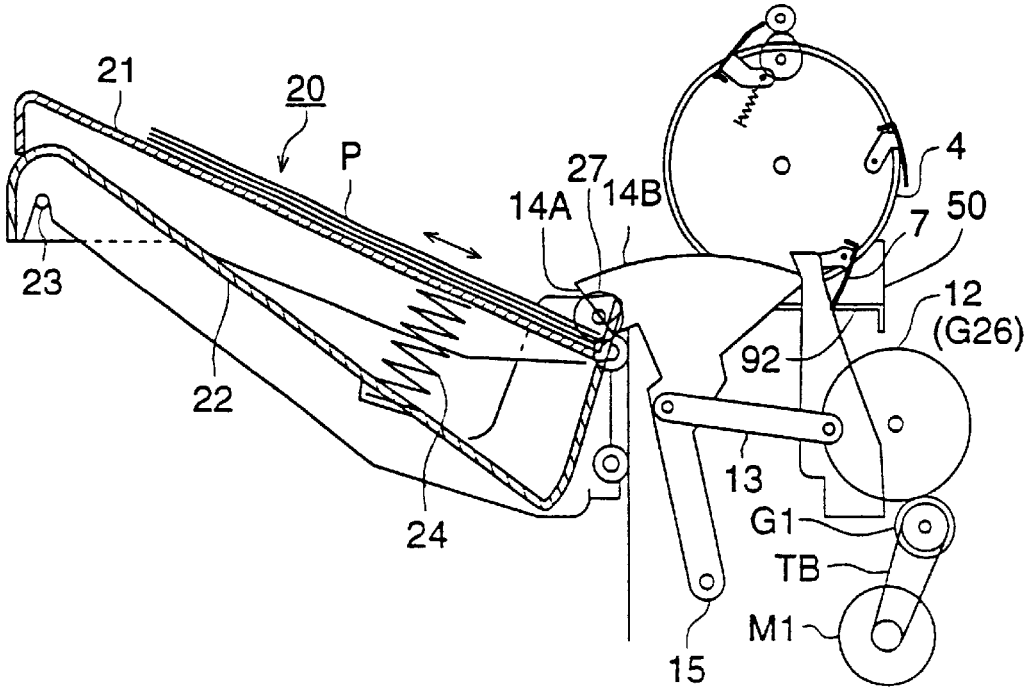
FIGS. 5(*a*) and 5(*b*) are partial cross-sectional views showing the sheet transporting process of the sheet processing apparatus.
Figure 5:
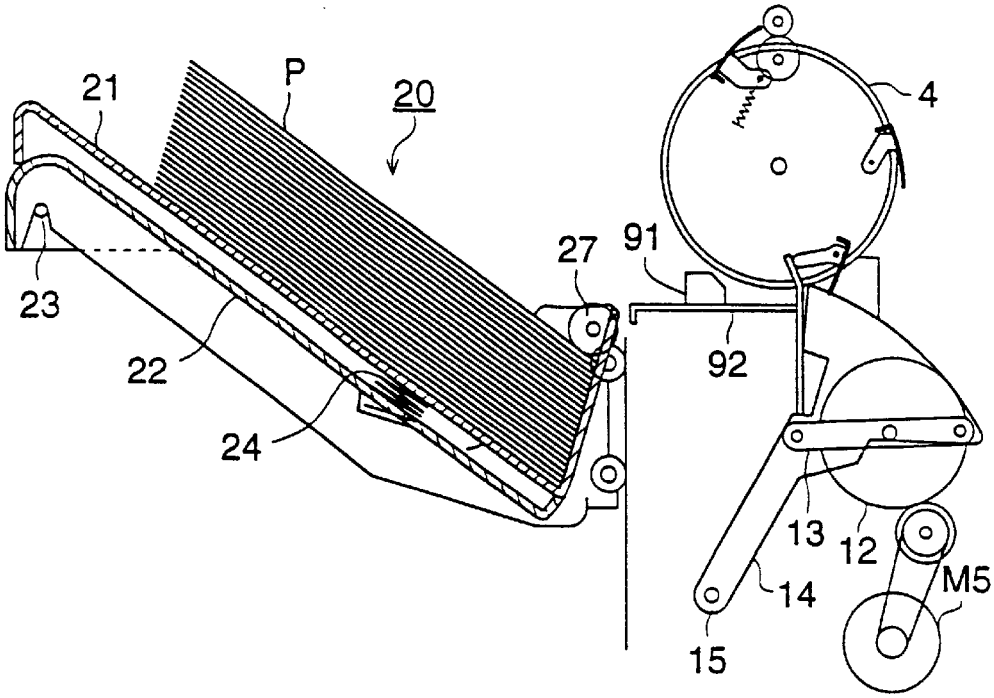

FIG. 3 through FIG. 5 are partial cross-sectional views showing the process of sheet transport in the sheet processing apparatus.

In FIG. 3(*a*), in the process of transport of the leading edge of sheet P, which is pressed and held by the front end portion of aforesaid spring-urged gripper 6 on the circumferential surface of sheet transporting drum 4, when the speed of transport roller pair 5 is increased, the portion near the trailing edge of sheet P has its speed increased by transport roller pair 5 to be fed excessively, resulting in the intermediate portion of sheet P to be of the shape swelling outward apart from the circumferential surface of sheet transporting drum 4.

In FIG. 3(*b*), while sheet transporting drum 4 further continues to rotate, at the moment when the trailing edge portion of sheet P is released out of the nip position of transporting roller pair 5, sheet P is inverted by the transporting force of transporting roller pair 5 and the stiffness of sheet P, and is detached from the circumferential surface of sheet transporting drum 4. When the leading edge portion of sheet P is butted at reference surface 7S of reference surface member 7 (hereinafter referred to as stopper 7) to stop the movement of sheet P, gripper 6 releases sheet P.

As shown in FIG. 4(*a*), in the process of continuing the rotation of sheet transporting drum 4, two sheet truing-up members 8A and 8B supported to be able to rotate at the two positions in sheet transporting drum 4 rub the portions near the leading edge of sheet P successively one after another to make the leading edge of sheet P contact with reference surfaces 7S of stopper 7; thus sheets P are trued up in the direction of transport. The leading edge portion of the trued up sheets P is placed on intermediate receiving tray 92, and the trailing edge portion is placed on sheet stacking plate 21 of upper sheet receiving tray 20.

As described above, the sheet transport path for the sheet with an image formed on it is the same in both the stapling process mode and non-stapling process mode. Further, the reference surfaces for butting the leading edge of the sheet are set at the same positions in both the stapling process mode and non-stapling process mode.

Further, reference surfaces 7S are positioned inside the both side edges for all the sheet sizes discharged from image forming apparatus mainframe 100, even when sheet P is shifted to the direction perpendicular to the sheet transport direction.

FIG. 4(*b*) is a drawing showing the positional relationship between reference surfaces 7S of stopper 7 and sheet transporting drum 4.

Reference surfaces 7S are positioned at the downstream side in the sheet transport direction from the position just under the rotational axis of sheet transporting drum 4 for holding the leading edge portion of the sheet to invert it. That is, distance L between the plumb line shown by the broken line just under the rotational axis of sheet transporting drum 4 and reference surfaces 7S is set at a predetermined distance, for example, approximately 10 mm downstream the sheet transport direction. Owing to this, the leading edge portion of sheet P held between spring-urged gripper 6 and sheet transporting drum 4 is reliably butted at the reference surfaces 7S to stop, and the gripper 6, which has released the sheet P, rotates together with sheet transporting drum 4 to be ready to the successive sheet holding.

At least two reference surfaces 7S are arranged in the sheet width direction perpendicular to the sheet transport direction and are movable in the sheet width direction corresponding to the movement of staplers 50 under stapling process.

Further, the upper portion of reference surface 7S is formed to be a curved surface 7R bending to the sheet side. This curved surface 7R is formed to be a curved surface having a radius of curvature approximately 30 mm. Even if a number of transported sheets P, the leading edges of which are curved upward, are stacked, the leading edges of sheets P never rides over reference surfaces 7S, because the leading edge portion proceeding to stopper 7 is hindered by this curved surface 7R to be pressed downward.

Next, in the process shown in FIG. 4(*c*) where the leading edge of sheet P is butted at reference surfaces 7S of stopper 7, truing-up members 91 trues up sheets P in the width direction (direction perpendicular to the sheet transport direction) (width truing-up). In another case where the shift mode is set, truing-up members 91 are alternately shifted to the predetermined plural positions to make said width truing-up. After completion of the positioning of first sheet P by one rotation of sheet transporting drum 4, second sheet P is fed into sheet transporting drum 4, further transported as mentioned above, with its position regulated, and then stopped. In this way, when the number of sheets P, which have been batted at the reference surface 7S of the stopper 7 to be properly positioned, reaches the predetermined number, they are stapled at their specified positions and bound together by staplers 50. Further, in the case where the shift mode is set, after the shifting operation by truing-up members 91, sheet truing-up (width truing-up) is carried out and the sheet is made to collide with stopper 7. When simple paper ejecting is done in the non-stapling process mode, the paper sheets are trued up and made to collide with stopper 7.

Stopper 7 is fixed on the moving carriage of staplers 50, and is movable together with the staplers as a united member.

Figure 11:
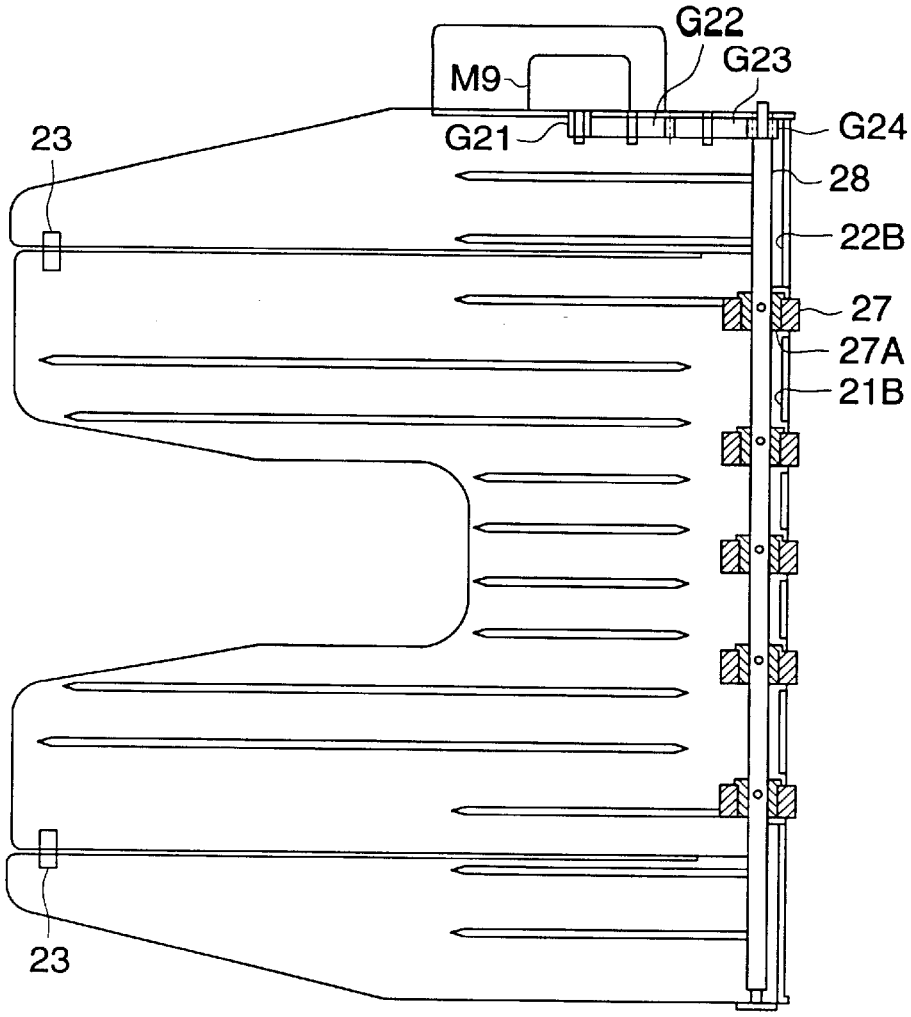
FIGS. 11(*a*) and 11(*b*) are the plan and the front view of the receiving tray means.
Figure 11:
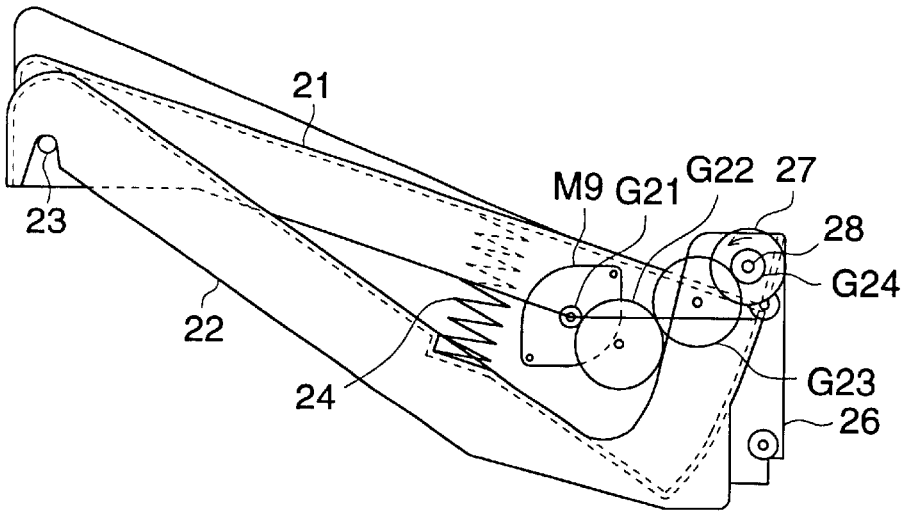
Figure 12:
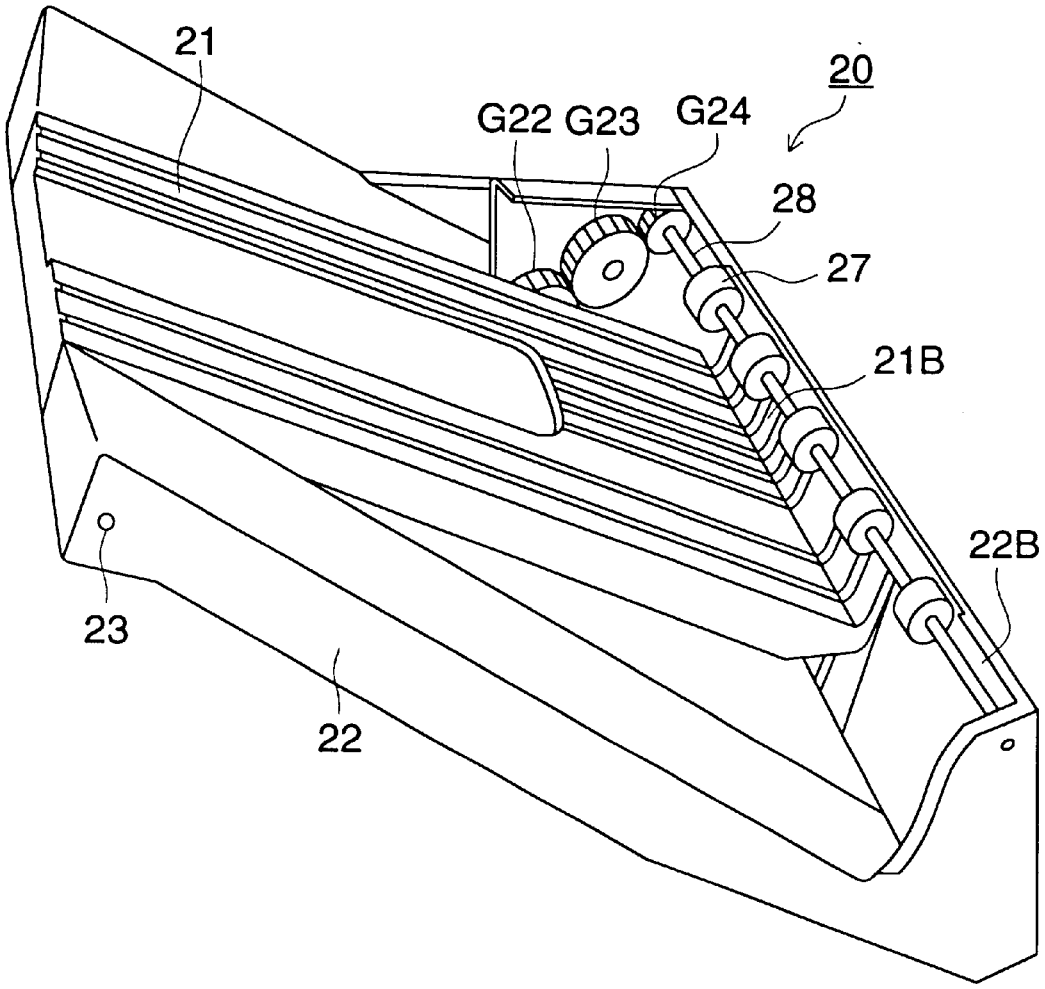
FIG. 12 is a perspective view of the receiving tray.

FIG. 1 and FIG. 5(*a*) are drawings showing how sheet P, for which a stapling-process or non-stapling process (shifting process, simple ejecting) is completed, is ejected onto sheet stacking plate 21 or onto fixed plate member 22. FIG. 11(*a*) is the plan of the upper sheet receiving tray 20, FIG. 11(*b*) is the front view of upper sheet receiving tray 20, and FIG. 12 is a perspective view of upper sheet receiving tray 20.

In FIG. 1, driving motor M5 of ejecting unit 11 drives to rotate disk 12 through the drive transmitting system composed of timing belt TE1, gear G25, and gear G26. The other end of crank 13 with its one end supported at an eccentric position of disk 12, is supported by a shaft to be able to rotate freely at a part of ejecting arm 14 which is capable of oscillating around supporting shaft 15. Disk 12 driven to rotate by motor M5 makes crank 13 to move eccentrically and further makes ejecting arm 14 oscillate. By this oscillating motion of ejecting arm 14, front end portion 14A of ejecting arm 14 presses the leading edge portion of sheet P, for which the sheet processing is completed, to push it out from the position in contact with stopper 7 toward sheet receiving plate 21 and fixed plate member 22 of upper sheet receiving tray 20. Sheet P that has been pushed out by ejecting arm 14, after sliding on the upper surfaces of sheet stacking plate 21 and fixed plate member 22, goes down by their own weight until the leading edge portion collides with sheet stopping surface 21B and stop. Front end portion 14A of ejecting arm 14 comes forward to near the position just over sheet stopping surface 21B of sheet stacking plate 21; hence, the bundle of the sheets is reliably moved onto sheet stacking surface 21A of upper receiving tray 20.

Now, because upper sheet receiving tray 20 and lower sheet receiving tray 30 have the same shape, upper sheet receiving tray 20 will be explained as the representative in the following.

Upper sheet receiving tray 20 comprises of fixed plate member 22, sheet stacking plate 21, supporting shaft 23 attached to the fixed receiving plate for supporting one end of sheet stacking plate 21 to be able to oscillate around it, and spring 24 for urging upward the other end of sheet stacking plate 21.

Sheet stacking surface 22A of fixed plate member 22 is formed to make an inclined surface in such a manner as to make the leading edge portion of the stacked sheets high and the trailing edge portion low. At the lower side of this inclined surface, curved stopping surface portion 22B is formed integrally.

Fixed plate member 22 is engaged with and fixed to the going-up-and-down means of the sheet processing apparatus mainframe and is driven to go up and down.

Sheet stacking surface 21A of sheet stacking plate 21 is disposed between side walls 22A of the fixed plate member 22 positioned to the both sides of sheet stacking surface 21A, is engaged with the fixed plate by supporting shaft 23 to be able to oscillate, and is urged upward by spring member 24, with its engaging surface made to be in contact with the stopper (not shown), to be stopped at the upper limit position. The upper end of spring member 24 is positioned at the bottom of sheet stacking plate 21, and fixed by an engaging member. The lower end of spring member 24 is loosely fitted in the concave portion provided at the bottom of fixed plate member 22 for positioning.

The sheets ejected out of the machine by ejecting unit 11, after being discharged on sheet stacking surface 21A, slide down along sheet stacking surface 21A due to their own weight, and their trailing edges come down toward sheet stopping surface 21B, until they collide with sheet stopping surface 21B to be stopped, pushed by rotating roller 27 for truing up the edges.

In addition, upper surface 14B of ejecting arm 14 is made to form a circular arc to extend to the rear direction. When the ejecting arm oscillates to the left to go forward as shown in the drawing, because above-mentioned upper surface 14B extends backward to make no clearance between sheet transporting drum 4 and ejecting arm 14, there is no risk for the operator to insert his fingers inadvertently to be gripped in between.

FIG. 5(*b*) is a drawing showing how a number of sheets P are ejected and stacked on sheet stacking plate 21 and fixed plate member 22, after being subjected to stapling process or non-stapling process.

When a lot of sheets P are stacked on sheet receiving tray 20 to exceed the specified weight, sheet stacking plate 21 oscillates around shaft 23 to go down against the urging force of spring member 24 due to the own weight of sheets P. In this case too, the leading edge portion of sheets P collides with sheet stopping surface 21B to be stopped and is trued up. In the process of the above-mentioned sheet stacking, no frictional resistance is given to the leading edge portion of sheets P to let sheet stacking plate 21 go down smoothly, because the leading edge portion of sheets P contacts with sheet stopping surface 21B of sheet stacking plate 21 capable of going up and down for truing up.

When the top of further stacked sheets P exceeds the top of sheet stopping surface 21B, the leading edge portion of sheets P collides with stopping surface portion 22B of fixed plate member 22 to be stopped.

In FIG. 11 and FIG. 12, ejecting rollers 27 are provided to be able to rotate for driving over sheet stopping surface 21B of sheet stacking plate 21 and over fixed plate member 22. Ejecting rollers 27 (elastic rollers) are formed of soft rollers having elasticity (sponge rollers) made up of a foamed resin or the like, and fixed on rotating shaft 28 through holding member 27A. These plural ejecting rollers 27 are disposed on rotating shaft 28. This rotating shaft 28 is supported to be able to rotate on the both side walls of fixed plate member 22 in the direction perpendicular to the sheet transport.

Rotating shaft 28 rotates in the counter-clockwise direction shown in FIG. 11(*b*), with the driving force transmitted through the transmission system composed of gears G21, G22, G23, and G24 from driving motor M9 as a driving source.

Upper sheet receiving tray 20 according to this invention, comprises of driving motor M9, drive-transmitting members G21 through G24, sheet stacking plate 21, fixed plate member 22, ejecting rollers 27, and so forth, these members forming a paper discharging unit integrally assembled together. Accordingly, this unit as a whole can be separately assembled, adjusted, and exchanged with the other unit apart from the sheet processing apparatus mainframe. Lower receiving tray means 30 is also made up as a unit in the same manner.

In FIG. 5(*a*), when sheet P is ejected onto upper sheet receiving tray 20 with the actuation of ejecting arm 14, ejecting rollers 27 start to be driven to rotate in the counter-clockwise direction by the actuation of driving motor M9. By the start of oscillation of ejecting arm 14, front end portion 14A presses the leading edge portion of sheet P to eject sheet P onto upper sheet receiving tray 20. At this time, the upper side surfaces of the rotating ejecting rollers contact with the lower side of sheet P to assist the transport of the leading edge portion of sheet P, making sheet P surely pass over sheet stopping surface 21B of upper sheet receiving tray 20.

When sheet P is conveyed to the stacking surfaces of sheet stacking plate 21 by ejecting arm 14 and ejecting rollers 27, sheet P glides down along sheet stacking surface 21A arranged with inclination or along the surface of the preceding stacked sheets with its leading edge downward; further, the leading edge portion of the sheet is pressed and held between the lower side surfaces of the rotating ejecting rollers and the inclined surface, until it is forced to collide with stopping surface portion 21B of sheet stacking plate 21 and stopping surface portion 22B of fixed plate member 22 to be stopped, with the leading edge trued up.

In FIG. 1, when the sensor detects that stacked sheets P are full (the upper limit of the stacking) of sheet receiving tray 20 and generates a signal, the control section (not shown) drives driving motor M6 for making the trays going up and down in driving means 40 for making the trays going up and down to make upper sheet receiving tray 20 go up. That is, a series of gears, composed of gears G5, G6, G7, G8, G9, and G10, drive to rotate driving pulley 41, driven by driving motor M6. Around said driving pulley 41 and upper driven pulley 42, driving wire 43 is entrained. Driving wire 43 moves up and down in a vertical direction by means of driving pulley 41.

At a certain point of driving wire 43, the base portion of the framework of aforesaid upper sheet receiving tray 20 is fixed by a suspending metal fitting. Framework 26 of upper sheet receiving tray 20 and framework 36 of lower receiving tray 30 are coupled by coupling rod 45. That is, long slot portion 451 is bored in coupling rod 45, and pin 46 fixedly attached to framework 26 of upper sheet receiving tray 20 is inserted to slide in said slot. Further, the portion near the lower end of coupling rod 45 is fixed to framework 36 of lower sheet receiving tray 30.

When upper sheet receiving tray 20 is removed upward by driving wire 43, pin 46, which is fixedly attached to framework 36 of upper sheet receiving tray 20 (refer to FIG. 1), slides in long slot portion 451 of coupling rod 45, and only upper sheet receiving tray 20 is removed upward. When pin 46 collides with the topmost end of long slot portion 451 of coupling rod 45, removed upper sheet receiving tray 20 is separated from still-standing lower sheet receiving tray 30 with the largest spacing distance.

When upper sheet receiving tray 20 is further removed upward by driving wire 43, pin 46 of upper sheet receiving tray 20 makes coupling rod 45 move upward by pushing up the topmost end of long slot portion 451, to raise lower receiving tray 30, which is fixed to the lower end portion of coupling rod 45, to move upward. Accordingly, upper sheet receiving tray 20 and lower sheet receiving tray 30 move upward as a united unit, keeping said largest spacing distance.

Figure 6:
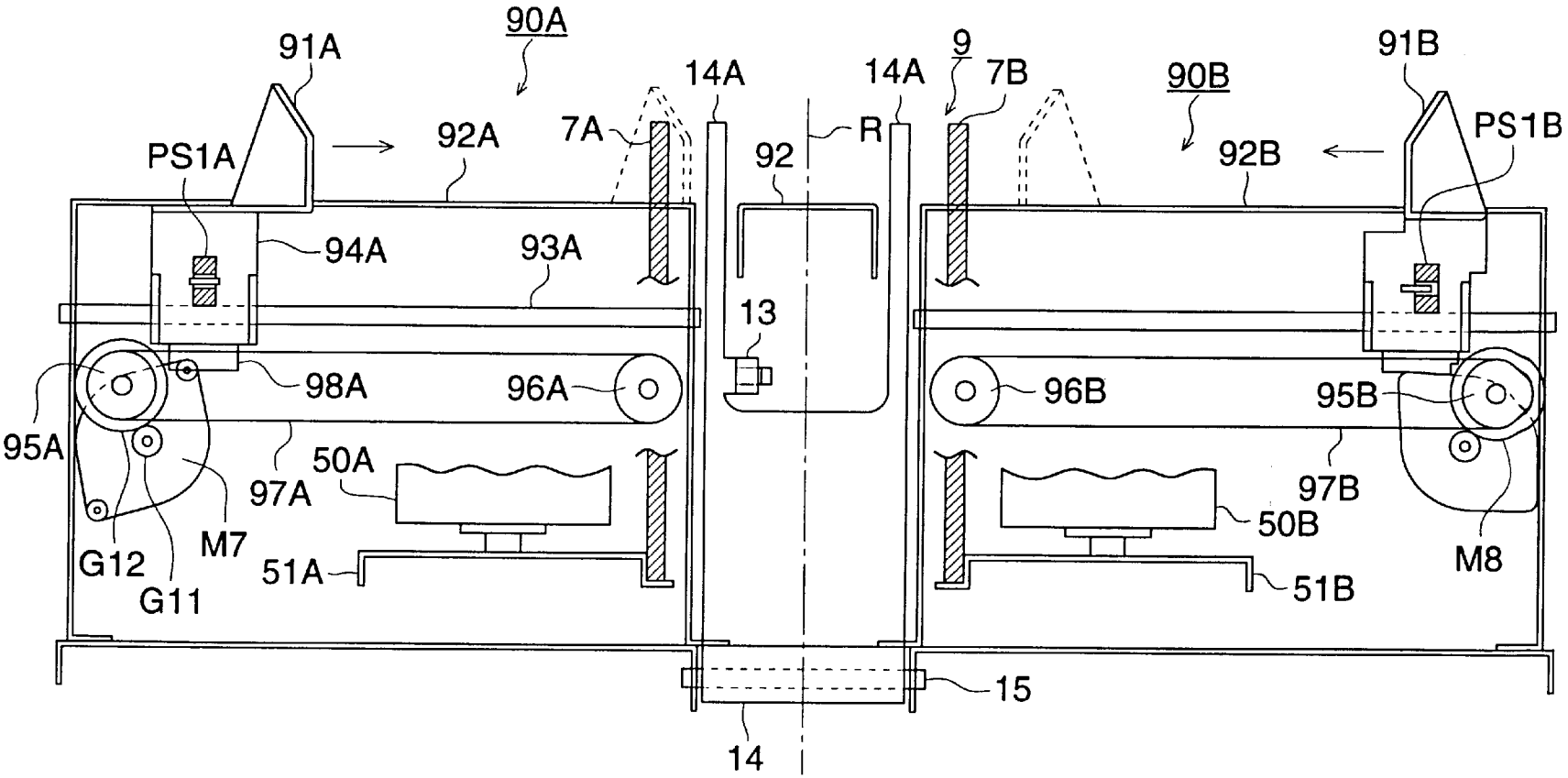
FIG. 6 is the front view of the shift truing-up means.

FIG. 6 is the front view of the shift truing-up means 9.

Shift truing-up means 9 comprises of first unit 90A shown in the left side in the drawing, which moves one truing-up member 91A (hereinafter referred to as truing-up plate 91A), and second unit 90B shown in the right side in the drawing, which moves the other truing-up member 91B (hereinafter referred to as truing-up plate 91B). Because these two units 90A and 90B have substantially the same structure, in the following, first unit 90A will be explained as the representative.

Truing-up plate 91A is fixed to carriage 94A, which is capable of straightly moving forward and backward sliding on guiding bar 93A supported fixedly in the unit encasing member serving also as intermediate receiving plate 92A. Said carriage 94A is fixed to a predetermined point of timing belt 97A, which is entrained around driving pulley 95A and driven pulley 96A, with fixing member 98A. Driving pulley 95A is driven to rotate by driving motor M7 of the driving source through gears G11 and G12. PS1A is the home position sensor. In the same way, second unit 90 B is driven to move forward and backward by driving motor M8 of the other driving source through the aforesaid gears and timing belt 97B. In this manner, truing-up plates 91A and 91B have their own driving motors respectively to be able to move independently.

The intermediate plates are separately and fixedly provided as central intermediate plate 92 and intermediate plates 92A and 92B disposed at both sides of said central intermediate plate 92, and each upper surface of these intermediate plates 92, 92A, and 92B is flush with each other, forming the sheet stacking surface for sheets P. Ejecting arm 14 is provided to be capable of oscillating at the center of the paper width direction, which is perpendicular to the sheet transport direction, and end portion 14A of its upper portion is inserted into the clearance portions formed between central intermediate receiving plate 92 and intermediate plates 92A and 92B disposed at the left and right of central plate 92, with the upper portion of upper end portion 14A protruded out of the sheet stacking surface of intermediate plates 92A and 92B to a height higher than the topmost sheet at the largest limit of the stacked sheets specified.

The end portions of stoppers 7A and 7B, engaging with the leading edge portion of sheet P for positioning, are provided at the outer sides of end portion 14A of ejecting arm 14 respectively one at the left and the other at the right, and are movable. The upper end of the end portion of stoppers 7A and 7B is specified to have approximately the same height as end portion 14A of ejecting arm 14.

The base portion of stopper 7A is fixed to moving stage 51A which holds stapler 50A (stapling unit) and is movable. The base portion of stopper 7B is fixed to moving stage 51B which holds stapler 50B (stapling unit) and is movable. Accordingly, stoppers 7A and 7B move in the direction of the paper width with the straight movement of staplers 50A and 50B.

In addition, stoppers 7A and 7B is provided at the inner sides of staplers 50A and 50B respectively, however, it may be appropriate to make positioning reliable by providing auxiliary stoppers at the outer sides of staplers 50A and 50B to engage with the both sides of large-sized sheets.

Figure 7:
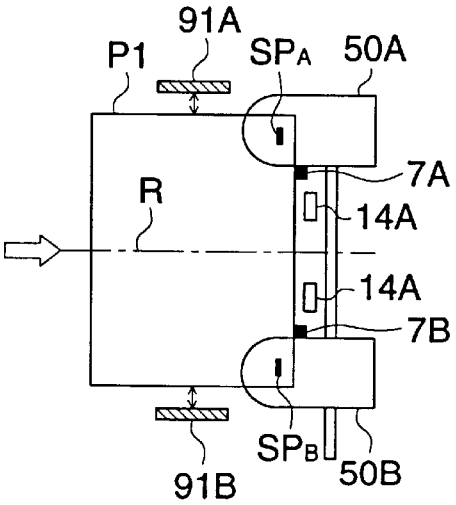
FIGS. 7(*a*) through 7(*c*) are schematic plans showing the operation of truing-up plates at the time of stapling process.
Figure 7:
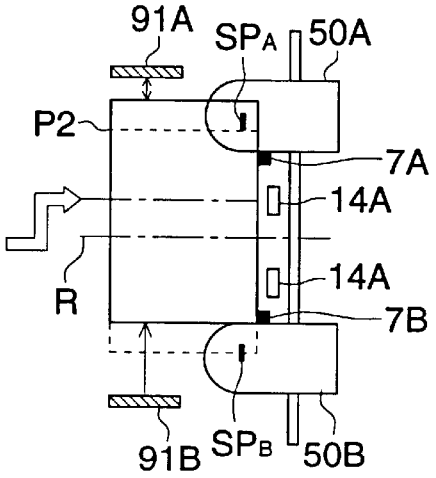
Figure 7:
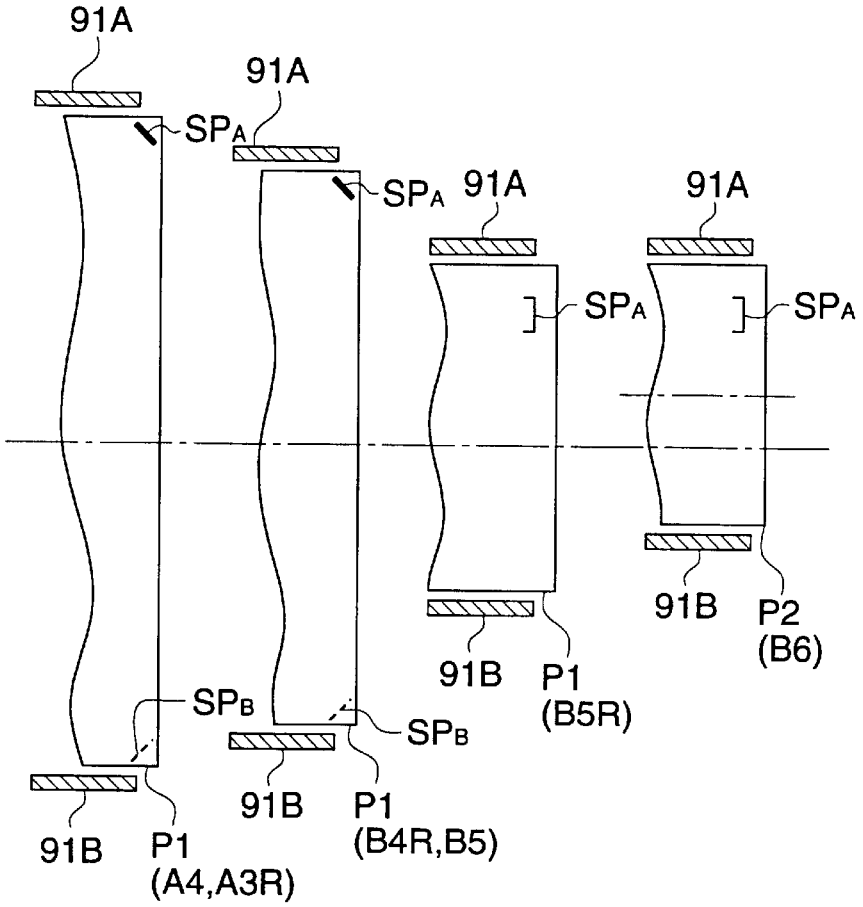

FIG. 7 is a schematic plan showing the operation of truing-up plates 91A and 91B in stapling process.

FIG. 7(*a*) shows how usual-sized sheet P1 is trued up for the width and staple-processed. As shown in FIG. 6, truing-up plates 91A and 91B are removed from the initial positions where home position sensors PS1A and PS1B are disposed to the positions a little more distant than the paper width of sheet P1, where they wait for the sheets, by driving motors M7 and M8 which are used only for the plates respectively. Every time when sheet P1 is fed in the vicinity of staplers 50, they are removed to positions a little narrower than the paper width to strike the side edges of sheet P1 for width truing-up. At the time of this width truing-up, the leading edge portion of sheet P1 is already trued up by being butted at reference surfaces 7S of stoppers 7A and 7B.

After the predetermined number of sheets P1 have come to end portion 14A of ejecting arm 14, any one or both of staples $SP_A$ and $SP_B$ is processed (stapling process) by any one or both of staplers 50A and 50B. The trailing edge portion of stapled sheets P1 is ejected onto sheet receiving tray 20 (or 30) by end portion 14A of oscillating ejecting arm 14.

FIG. 7(*b*) shows how small-sized sheet P2 (B6 size, A6 size, etc., for example) is trued up for the width and staple-processed.

When the stapling process is executed for small-sized sheets P2, every time when a sheet is fed from sheet transporting drum 4 into staplers 50A and 50B and collides with stoppers 7, one of truing-up plates 91B moves from the initial position and presses the side edge of sheets P2 to shift sheets P2 to one side, while the other of truing-up plates 91A moves from the initial position and strikes the side edge of sheets P2 to true them up for the width. At the time of this width truing-up, the leading edge portion of sheet P2 is already trued up by being butted at reference surfaces 7S of stoppers 7A and 7B.

Reference surfaces 7S of stoppers 7A and 7B are specified to be positioned at the inner sides of the both side edges of smallest-sized sheet P in the width direction.

FIG. 7(*c*) is a plan showing the sheets of various sizes and the positions of stapling. Staplers 50A and 50B are removed by a driving source (not shown) and stop at the predetermined different positions respectively for each sheet size to process staples $SP_A$ and $SP_B$. When small-sized sheet P is stapled, the stapling process is done after one of truing-up plates 91B is shifted to move sheet P2 to the other of truing-up plates 91A, because staplers 50A and 50B can not approach the specified stapling positions due to ejecting arm 14 and so forth disposed in the vicinity of the center.

Figure 8:
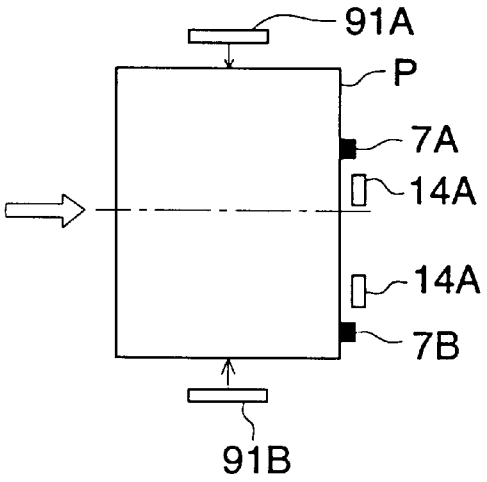
FIGS. 8(*a*) and 8(*b*) are schematic drawings showing the operation of the truing-up plates at the time of shifting process.
Figure 8:
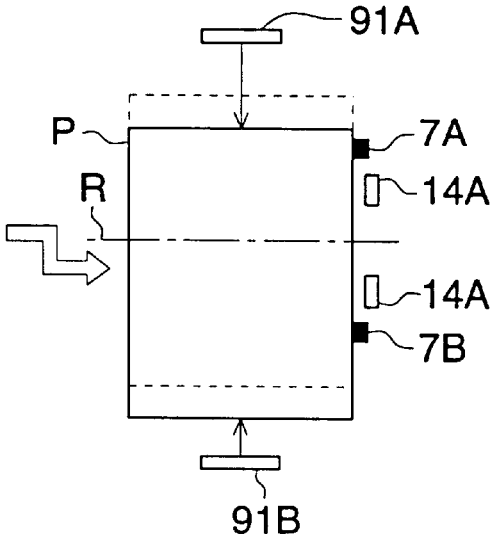

FIGS. 8(*a*) and 8(*b*) are schematic drawings showing the operation of truing-up plates 91A and 91B in shift processing.

FIG. 8(*a*) shows how the bundle of the sheets of the odd-numbered order is processed. When the shift mode (off-set mode) is set, corresponding to the sheet size, truing-up plates 91A and 91B, each of which is located at the initial position with an equal distance apart from central line R, move to the positions where are a little wider than the sheet width, maintaining the equal distance from central line R. Then, the bundle of the sheets is received, and ejected after processing.

FIG. 8(*b*) shows how the bundle of the sheets of the even-numbered order is processed. After the bundle is received at the same position as the bundle of the odd-numbered order, truing-up plates 91A and 91B move until they stop at the positions which are at the distance unequal for each against central line R in the direction of the sheet transport, and ejected after processing. In addition, in this shift mode, it may be appropriate to make the aforesaid width truing-up.

Figure 9:
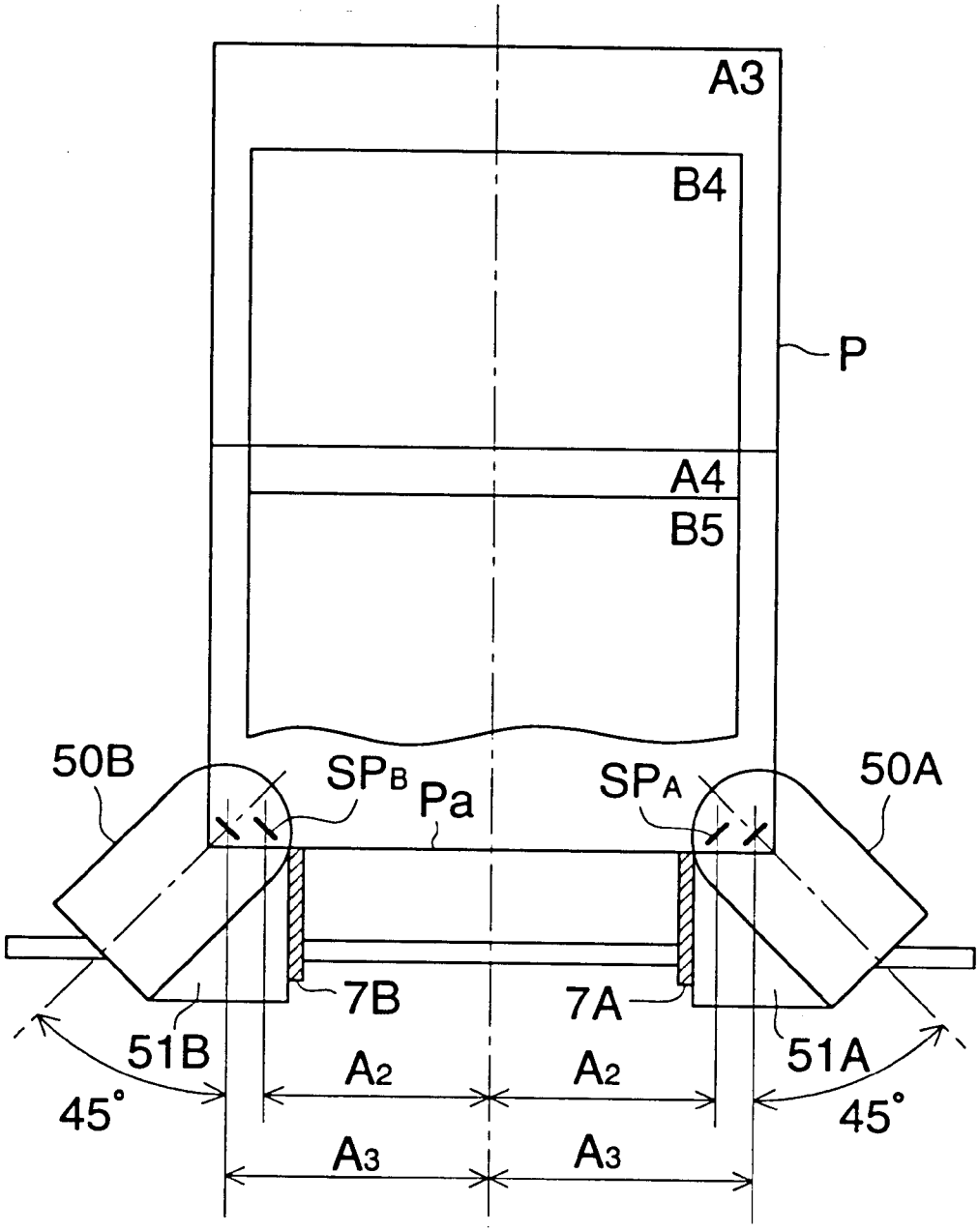
FIG. 9 is a plan showing the process of moving of the stapler stapling sheets of various sizes being in contact with the stopper.

FIG. 9 is a plan showing the process of moving of staplers 50A and 50B which force staple $SP_A$ or $SP_B$ into one end of leading edge portion Pa of sheets P of various sizes being in contact with stoppers 7A and 7B. Stapler 50A or 50B moves straight in the direction parallel to the leading edge of sheet Pa, keeping the positions disposed at 45° inclination, and forces staple $SP_A$ or $SP_B$ at the stapling positions of specified distances $A_2$ and $A_3$.

FIG. 10(*a*) is a plan showing how staples $SP_A$ and $SP_B$ are forced into the two points each positioned with an equal distance from central line R of sheets P of various sizes. FIG. 10(*b*) is a plan showing the arrangement of staplers 50A and 50B, which staple at the above-mentioned two points. Staplers 50A and 50B are disposed obliquely at the aforesaid home positions each being equally $A_0$ distant from central line R of sheet P (the positions shown by the broken lines in the drawing), however, when the two point stapling is instructed, they are rotated by the driving means, which will be described later, to be arranged in the positions parallel to central line R of sheet P, being in contact with stoppers 7A and 7B. By these parallel-arranged staplers 50A and 50B, staples $SP_A$ and $SP_B$ are forced parallel into the two points of sheet P.

The sheet processing apparatus of this invention has a compact structure and its mechanism relating to the basis for sheet stopping is simplified, by making the sheet transport path and the reference surface for butting the leading edge of the sheet the same for both the stapling process mode and non-stapling process mode. Further, the position of sheet stopping is made accurate and stabilized for the smallest size through the largest size. Moreover, because the leading edge of the sheet always contacts with the reference surface for butting the leading edge of the sheet, even in case of shift truing-up, sheet truing-up is accurately carried out.

Figure 13:
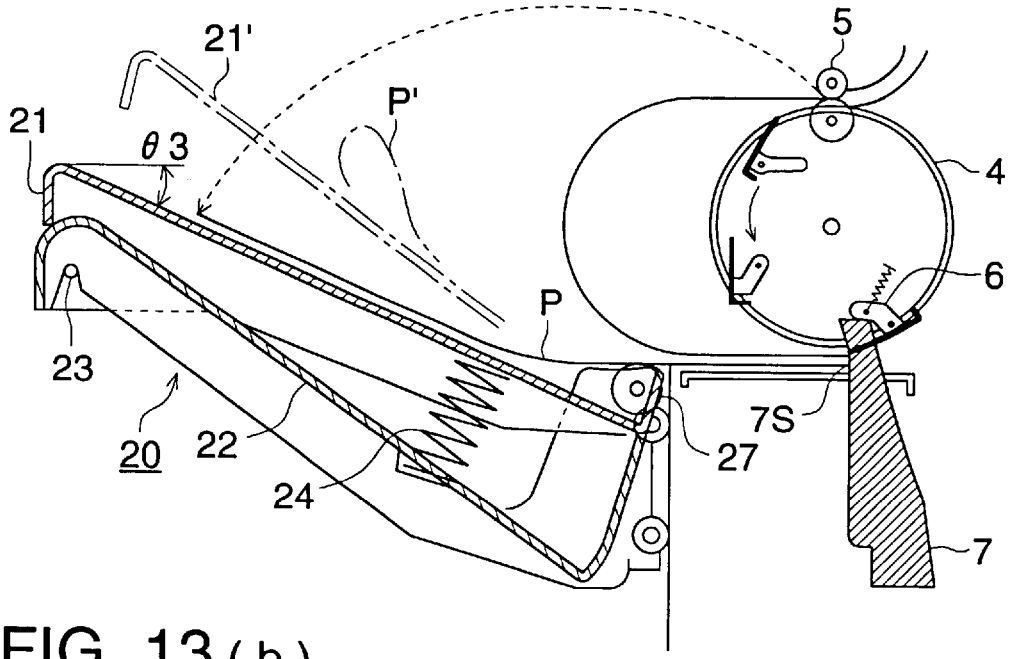
FIGS. 13(*a*) and 13(*b*) are cross-sectional views showing the initial state of going up when sheets start to be stacked on the movable receiving tray, and the state of going down when the maximum number of sheets are stacked.
Figure 13:
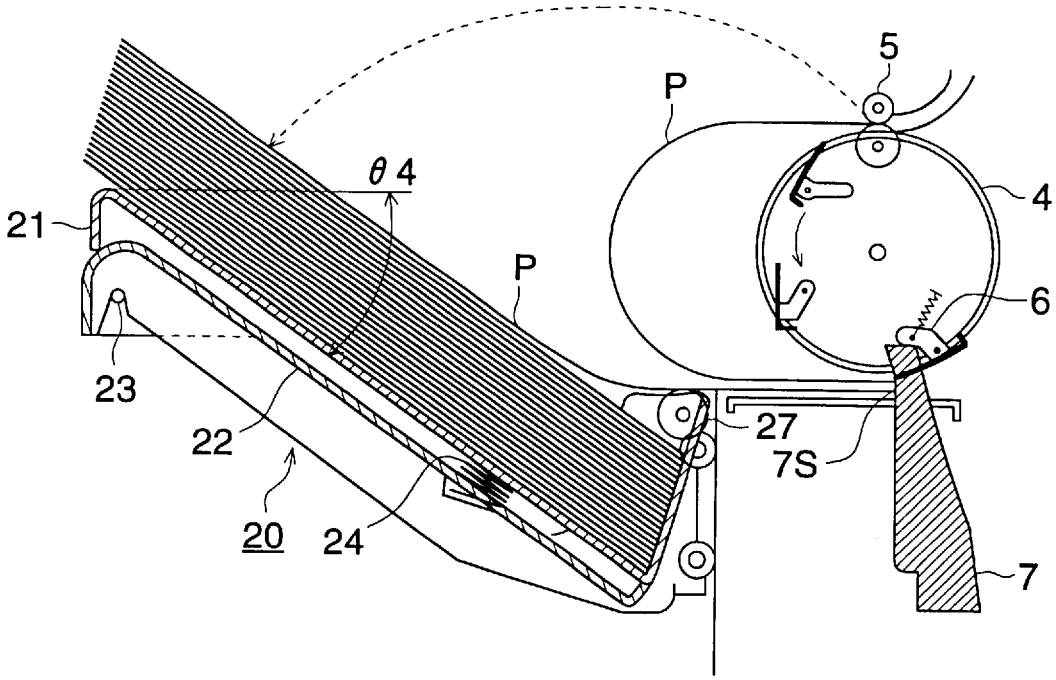

FIG. 13(*a*) is a cross-sectional view showing the initial uprising state of the sheet stacking plate 21 on which sheets P are being stacked.

The sheet stacking surface of sheet stacking plate 21 is made to be an inclined plane in a manner such that the downstream side in ejecting sheet P out of the outer peripheral surface of sheet transporting drum 4 is higher than the upstream side. In the initial going-up state of sheet stacking plate 21, the angle of inclination of the sheet receiving plate against horizontal plane θ3 is set to be not larger than 20°. If the angle of inclination of sheet stacking plate 21 is larger than 20°, for example, if sheet stacking plate 21 is inclined plane 21' that is larger than inclination angle 20° shown by the single dot and dash line in the drawing, the trailing edge of sheet P of large size (for example, A3 size, 11_17 inch size, etc.) discharged from the nip position of transporting roller pair 5, after contacting with inclined plane 21', bends downward along inclined plane 21', to make a curl-shape as shown by the single dot and dash line P' in the drawing; further, the trailing edge of sheet P is made to have a shape as folded downward. If successive sheet P is fed onto inclined plane 21' in such a state of sheet with its trailing edge deformed, poor paper ejecting occurs.

In addition, in the case where the receiving tray is of a type such that sheet P ejected onto sheet stacking plate 21 that is arranged inclined is made go down by its own weight in the direction reverse to the sheet transport to collide with sheet stopping surface 21B, inclination angle θ3 of sheet stacking plate 21 is set to be not larger than 20° and not smaller than 10°.

FIG. 13(*b*) is a cross-sectional view showing the going-down state of sheet stacking plate 21 on which the maximum number of sheets P are stacked.

In the state where the maximum number (for example, about 500 sheets) of sheets P are stacked and sheet stacking plate 21 oscillates around supporting shaft 23 of fixed plate member 22 to the lowermost position, inclination angle θ4 of the sheet stacking plane of sheet stacking plate 21 against the horizontal plane is set to be not larger than 35°. If the angle of inclination θ4 of sheet stacking plate 21 is larger than 35°, as in the case of FIG. 13(*a*), the trailing edge of large-sized sheet P discharged from the nip position of transporting roller pair 5, after contacting with the topmost plane of the bundle of the sheets stacked on the steep inclined plane larger than 35°, bends downward to have a curled shape along the sheet surface on this steep inclined plane; further, the trailing edge of sheet P is made to have a shape as folded downward. If successive sheet P is fed onto inclined plane 21' in such a state of sheet with its trailing edge deformed, poor paper ejecting occurs.

Further, inclination angle θ4 of sheet stacking plate 21 should be most favorably not larger than 20°, but if it is not larger than 35°, when above-mentioned large-sized sheet P is stacked on sheet stacking plate 21, no problem will occur. In the case of the oscillating type sheet stacking plate 21, it is desirable that inclination angle θ3 in the initial state is set to be not larger than 20°, and inclination angle θ4 in the last state to be not larger than 35°.

In addition, in the embodiment of this invention, the sheet processing apparatus connected to a copying machine is shown, however, the invention can be employed in the after-record processing apparatus that is used connected with an image forming apparatus such as a printer and a facsimile, a low-volume printer, or the like.

As has been described in the foregoing, because the inclination angle of the sheet receiving plate is set to be not larger than 20° in the initial going-up state, and to be not larger than 35° in the going-down state where the maximum number of sheets are stacked, even when the large sized sheets are inverted and stacked, the poor paper ejecting such as folding, scattering, and jamming of the sheets is prevented.

Further, because an elastic roller rotating for driving is provided over the sheet stopping surface which is provided at the upstream side in the direction of sheet ejection, and by the driving-rotation of this elastic roller, the sheet on the stacking surface of the sheet receiving plate is pressed and transported so as to make the leading edge of the sheet collide with the sheet stopping surface, the topmost sheet ejected onto the sheet receiving plate is reliably made to collide with the sheet stopping surface and trued up.

What is claimed is:

1. A sheet processing apparatus having selectable functions of either or both of stapling sheets together and shifting respective bundles of sheets so as to store said sheets at different discharging positions, wherein said sheets are fed from an image forming apparatus one by one after images are formed on said sheets, said sheet processing apparatus comprising:

a stapler to staple said sheets together;

a sheet guide which guides said sheets along a sheet transporting path from said image forming apparatus to a predetermined position irrespective of whether said sheet processing apparatus is in a stapling mode in which said stapler staples said sheets at said predetermined position or a non-stapling mode in which said stapler does not staple said sheets at said predetermined position, and irrespective of sizes of said sheets;

a truing member for arranging and shifting said sheets in a direction perpendicular to a sheet conveying direction at said predetermined position;

shift truing means for moving said truing member in the direction perpendicular to said sheet conveying direction so that a moving distance of said truing member for arranging said sheets is different from a moving distance of said truing member for shifting said sheets; and a reference surface which is immovable relative to said sheet conveying direction which is positioned so that edges of said sheets are butted against said reference surface at said predetermined position.

2. The sheet processing apparatus of claim 1, further comprising:

a sheet receiving tray which receives and stores said sheets; and a discharging unit which discharges said sheets, the edges of which are butted against said reference surface, onto said sheet receiving tray.

3. The sheet processing apparatus of claim 1, wherein a top portion of said reference surface has a bent shape, curving upstream toward a transporting direction of said sheets.

4. The sheet processing apparatus of claim 1, wherein said reference surface is adapted to move, in association with a movement of said stapler, to a position at which said reference surface does not interfere with a stapling operation of said stapler.

5. The sheet processing apparatus of claim 1, further comprising:

a sheet transporting drum mounted in said sheet transporting path to turn over each of said sheets by gripping a top edge portion of said sheets while transporting said sheets by rotating said sheet transporting drum, wherein the top edge portion of said sheets to be butted against said reference surface is directed toward a transporting direction of said sheets.

6. The sheet processing apparatus of claim 5, wherein said reference surface is located downstream of the transporting direction of said sheets, being farther than a plumb line position from a rotational center axis of said sheet transporting drum.

7. The sheet processing apparatus of claim 5, further comprising:

a discharging unit which discharges said sheets which are stacked at said predetermined position in a state such that the edges of said sheets are butted against said reference surface; and a sheet receiving tray which receives and stores said sheets, and having a sheet stacking plate which is inclined in such a manner that its downstream side in a discharging direction of said sheets is higher than its upstream side, and wherein an angle of inclination of said sheet stacking plate to a horizontal plane is not greater than 35°.

8. The sheet processing apparatus of claim 7, wherein said sheet receiving tray further includes:

a sheet stopping surface located upstream of the discharging direction of said sheets; and an elastic roller to butt the edges of said sheets against said sheet stopping surface, where the edges of said sheets are trailing edges toward the discharging direction of said sheets.

9. The sheet processing apparatus of claim 7, wherein:

said sheet receiving tray further includes a fixed plate member and a spring member; and said sheet stacking plate is mounted on said fixed plate member with a support of said spring member mounted therebetween, so as to vary the angle of inclination of said sheet stacking plate in accordance with a weight of said sheets stacked on said sheet stacking plate, with a lowest angle of inclination to the horizontal plane being not greater than 20°.

10. The sheet processing apparatus of claim 1, wherein said shift truing means moves said truing member so that said moving distance of said truing member for shifting said sheets is longer than said moving distance of said truing member for arranging said sheets.

11. The sheet processing apparatus of claim 1, wherein said truing member comprises two truing parts, and wherein said shift truing means moves said truing member so that said two truing parts move different distances when said truing member shifts said sheets.

* * * * *